US009993672B2

(12) United States Patent
Cordani

(10) Patent No.: US 9,993,672 B2
(45) Date of Patent: Jun. 12, 2018

(54) METHOD AND DEVICE FOR SUPPRESSING ELECTRICAL FIRES IN UNDERGROUND CONDUIT

(71) Applicant: GelTech Solutions, Inc., Jupiter, FL (US)

(72) Inventor: Peter Cordani, Palm Beach Gardens, FL (US)

(73) Assignee: GelTech Solutions, Inc., Jupiter, FL (US)

( * ) Notice: Subject to any disclaimer, the term of this patent is extended or adjusted under 35 U.S.C. 154(b) by 0 days. days.

(21) Appl. No.: 14/314,538

(22) Filed: Jun. 25, 2014

(65) Prior Publication Data

US 2014/0305666 A1 Oct. 16, 2014

Related U.S. Application Data

(63) Continuation-in-part of application No. 14/045,451, filed on Oct. 3, 2013.

(60) Provisional application No. 61/755,237, filed on Jan. 22, 2013.

(51) Int. Cl.

| | |
|---|---|
| ***A62C 2/00*** | (2006.01) |
| ***A62C 3/16*** | (2006.01) |
| ***A62C 35/10*** | (2006.01) |

(52) U.S. Cl.

CPC ..... *A62C 3/16* (2013.01); *A62C 35/10* (2013.01)

(58) Field of Classification Search

CPC ... F16L 9/19; F16L 9/18; F16L 11/127; F16L 7/02

USPC ..... 169/54, 56, 58, 70, 26–29; 252/1–8.05, 252/601–611; 138/108, 113, 114, 116; 174/68.1–136

See application file for complete search history.

(56) References Cited

U.S. PATENT DOCUMENTS

| | | | | |
|---|---|---|---|---|
| 4,751,947 | A * | 6/1988 | Landers | B29C 44/185 138/89 |
| 4,978,460 | A | 12/1990 | von Blucher et al. | |
| 5,087,513 | A | 2/1992 | Kim | |
| 5,190,110 | A | 3/1993 | von Blucher et al. | |
| 5,519,088 | A | 5/1996 | Itoh et al. | |
| 5,849,210 | A * | 12/1998 | Pascente | A62C 99/0045 169/45 |
| 5,927,312 | A * | 7/1999 | Dryden et al. | 137/1 |

(Continued)

*Primary Examiner* — Christopher Kim
*Assistant Examiner* — Adam J Rogers
(74) *Attorney, Agent, or Firm* — McHale & Slavin, P.A.

(57) ABSTRACT

A method and device for suppressing an electrical fire within an electrical wire carrying conduit. The device is a flexible receptacle containing an admixture of super absorbent polymer and water having substantially superior fire suppression and extinguishing properties that does not provide an electrically conductive environment. The receptacle is drawn though a conduit either before or after wires have been placed in the conduit, and the filled with the admixture. A sleeve may be placed over the receptacle to prevent breaching of the receptacle during installation. Once the receptacle and admixture is positioned within the conduit, should arcing or a buildup of heat occur, the receptacle will rupture and the admixture will cover the specific area. These particular properties and ratios of the admixture will enable electrical fires to be extinguished more rapidly and not flare back up. The admixture further encapsulates noxious and toxic gases associated with electrical fires.

11 Claims, 2 Drawing Sheets

(56) References Cited

U.S. PATENT DOCUMENTS

| | | | | |
|---|---|---|---|---|
| 5,985,385 | A * | 11/1999 | Gottfried | B32B 1/08 405/157 |
| 5,989,446 | A | 11/1999 | Hicks et al. | |
| 6,834,728 | B2 | 12/2004 | Demole | |
| 7,096,965 | B2 | 8/2006 | Ozment | |
| 7,104,336 | B2 | 9/2006 | Ozment | |
| 7,124,834 | B2 | 10/2006 | Sundholm et al. | |
| 2004/0216895 | A1* | 11/2004 | Boyce | A62C 3/16 169/5 |
| 2005/0150664 | A1* | 7/2005 | Miller et al. | 169/45 |
| 2006/0157668 | A1* | 7/2006 | Erdner et al. | 252/2 |
| 2008/0035354 | A1 | 2/2008 | Cordani | |
| 2008/0185553 | A1* | 8/2008 | Ziemer et al. | 252/8.05 |
| 2008/0217043 | A1* | 9/2008 | Schoke et al. | 174/110 R |
| 2010/0263761 | A1* | 10/2010 | Niccolls et al. | 138/146 |
| 2012/0250722 | A1* | 10/2012 | Barfoot | G08B 17/06 374/1 |
| 2012/0312562 | A1* | 12/2012 | Woehrle et al. | 169/46 |
| 2013/0220650 | A1* | 8/2013 | Muller | A62C 3/16 169/58 |
| 2013/0261244 | A1* | 10/2013 | Jousset et al. | 524/409 |
| 2014/0230918 | A1* | 8/2014 | Keith | 137/79 |
| 2017/0345527 | A1* | 11/2017 | Royston | H01B 7/295 |

* cited by examiner

METHOD AND DEVICE FOR SUPPRESSING ELECTRICAL FIRES IN UNDERGROUND CONDUIT

RELATED APPLICATIONS

In accordance with 37 C.F.R. 1.76, a claim of priority is included in an Application Data Sheet filed concurrently herewith. Accordingly, the present invention is a continuation-in-part of U.S. patent application Ser. No. 14/045,451, entitled "METHOD AND DEVICE FOR SUPPRESSING ELECTRICAL FIRES IN UNDERGROUND CONDUIT", filed Oct. 3, 2013, which claims priority to U.S. Provisional Patent Application No. 61/755,237, entitled "DEVICE FOR SUPPRESSING ELECTRICAL CONDUIT FIRES", filed Jan. 22, 2013. The contents of which the above referenced application is incorporated herein by reference.

FIELD OF THE INVENTION

This invention relates to the field of fire prevention, and more particularly to a device for placement within a conduit for dispersion of a fire suppressant should an electrical fire within the conduit occur.

BACKGROUND OF THE INVENTION

In many cities the utilities are located beneath the surface of the earth, usually beneath the surface of the streets. These utilities are placed in tunnels or conduits. In older cities, such as New York City, these utilities have been located in these for many years/decades. Over time, the conduits which carry these utilities wear out and break. A serious problem is the failure of electrical transmission lines in conduits and tunnels. These failures usually result in fires which must be quickly extinguished to prevent further damage.

While it is desirable to replace very old utilities in conduits and tunnels, it is not always practical. Due to financial restraints and other limitations, most of these electrical transmission lines have not been replaced, yet higher electrical demands are placed on the system. Unfortunately, failure of older electrical transmission lines can result in an electrical fire. These fires are commonly discovered when smoke is seen arising from manhole covers in the streets and sidewalks. It has been estimated by Consolidated Edison that there are approximately 40 electrical fires per day under the streets of New York City.

The cost of repairing and replacing the electrical transmission lines damaged by these fires is approximately $100,000.00 per linear foot of transmission line. Therefore, it is imperative that these fires be extinguished as quickly as possible. Inspection of electrical lines can help pinpoint potential trouble areas. Unfortunately, even an inspection of the lines can trigger a fire. For instance, the opening of a manhole cover can provide the oxygen needed to support a fire. Similarly, a lineman performing an inspection may disturb a conduit resulting in arcing of electric lines, possibly triggering a fire.

U.S. Pat. No. 6,834,728 discloses a system for extinguishing a fire in a tunnel. The system includes a conduit for delivering a fire extinguishing liquid and a trough extending parallel to the conduit for receiving liquid from the conduit. A carriage is arranged to move on a track which includes an upper edge of the trough. The carriage carries a pump having a nozzle, a video camera, and an inlet; each of which can be controlled robotically from a remote control station. The inlet is deployed in the trough to draw liquid from the trough.

U.S. Pat. No. 7,096,965 discloses a method of proportioning a foam concentrate into a non-flammable liquid to form a foam concentrate/liquid mixture and create a flowing stream of the foam concentrate/liquid mixture. The apparatus of this invention is adapted for expanding and dispensing foam and includes a housing defining an interior through which extends a discharge line. The ends of the housing are closed about the ends of the discharge line, and the ends of the discharge line extend beyond the ends of the housing to define a connector at one end for receiving a stream of foam concentrate/liquid and at the opposite end to define the foam dispensing end of the apparatus.

U.S. Pat. No. 7,104,336 discloses a method and apparatus for proportioning a foam concentrate into a non-flammable liquid to form a foam concentrate/liquid mixture and create a flowing stream of the foam concentrate/liquid mixture similar to the method and apparatus of U.S. Pat. No. 7,096,965.

U.S. Pat. No. 7,124,834 discloses a method for extinguishing a fire in a space such as a tunnel. The method includes spraying a fire extinguishing medium into the space by spray heads. In a first stage of the method, the flow and temperature of the hot gases produced by the fire are influenced by spraying an extinguishing medium into the space, especially by creating in the space at least one curtain of extinguishing medium. At least some spray heads in the space are pre-activated into a state of readiness. In a second stage of the method, at least one spraying head is activated to produce a spray of extinguishing medium.

U.S. patent application Ser. No. 11/680,803 is entitled "Process for Fire Prevention and Extinguishing", the contents of which are incorporated herein by reference. In this application, a process for retarding or extinguishing conflagrations using a super absorbent polymer in water is disclosed. The reaction of the water with the polymer creates a gel-like substance with a viscosity that allows the mixture to be readily pumped through a standardized 2.5 gallon water based fire extinguisher, yet viscous enough to cover vertical and horizontal surfaces to act as a barrier to prevent fire from damaging such structures, minimizing the manpower needed to continuously soak these structures.

U.S. Pat. No. 5,989,446 discloses a water additive for use in fire extinguishing and prevention. The additive comprises a cross-linked water-swellable polymer in a water/oil emulsion. The polymer particles are dispersed in an oil emulsion wherein the polymer particles are contained within discrete water "droplets" within the oil. With the help of an emulsifier, the water "droplets" are dispersed relatively evenly throughout the water/oil emulsion. This allows the additive to be introduced to the water supply in a liquid form, such that it can be easily educted with standard firefighting equipment.

U.S. Pat. No. 5,190,110 discloses the fighting of fires or protection of objects from fire by applying water which comprises dispersing in the water particles of a cross-linked, water-insoluble, but highly water-swellable, acrylic acid derivative polymer in an amount insufficient to bring the viscosity above 100 mPa's. Advantageously, the particles are present in an amount such that, after swelling, the swollen particles hold 60 to 70% by weight of the total water; the polymer being a copolymer of an acrylic acid, the water containing silicic acid and/or a silicate as well as sodium, potassium or ammonium ions. The water is freely pumpable, but the swollen particles adhere to surfaces they contact rather than running off rapidly.

U.S. Pat. No. 5,849,210 discloses a method of preventing or retarding a combustible object from burning including the steps of mixing water with a super absorbent polymer ("SAP") to form one at least partially hydrated SAP, and applying the at least partially hydrated SAP to the combustible object, before or after combustion. In another embodiment, an article of manufacture includes a SAP that is prehydrated and is useful for preventing a combustible object from burning, or preventing penetration of extreme heat or fire to a firefighter or other animal.

U.S. Pat. No. 5,087,513 discloses polybenzimidazole polymer/superabsorbent polymer particles. These articles are prepared by either mixing the super absorbent polymer particulates with the polybenzimidazole polymer solution during the formation of the polybenzimidazole article, or forming a composite of a polybenzimidazole film or fiber material layer with a super absorbent polymer particulate containing layer. These polybenzimidazole products absorb large amounts of fluid while retaining the flame retardancy and chemical unreactivity of conventional polybenzimidazole materials.

U.S. Pat. No. 4,978,460 discloses a particulate additive for water for firefighting containing a strongly swelling water-insoluble high molecular weight polymer as gelatinizing agent, which comprises a water-soluble release agent which causes the particles of said gelatinizing agent not to swell, the particles of the gelatinizing agent being encased or dispersed in the release agent. Suitable release agents include polyethylene glycol, sugars, mannitol, etc. The gelatinizing agent may be a moderately cross-linked water-insoluble acrylic or methacrylic acid copolymer.

U.S. Pat. No. 5,519,088 discloses an aqueous gel comprising a polymer of (meth)acrylamide or particular (meth) acrylamide derivative(s), particulate metal oxide(s) and an aqueous medium, a process for producing said gel, and products utilizing said gel. This aqueous gel can be produced so as to have transparency, be highly elastic and fire resistant and can prevent the spreading of flames. The aqueous gel when produced transparent, becomes cloudy when heated or cooled and is useful for the shielding of heat rays or cold radiation.

What is needed in the art is a method of suppressing fires and a device that can be placed within an electrical conduit to provide future fire suppression.

SUMMARY OF THE INVENTION

A method and device for suppressing the spread of and extinguishing electrical fires in an electrical conduit. The device is based upon a receptacle that is drawn into a conduit either before or after the electrical lines are inserted. The receptacle is inserted similar to a conduit used to support electrical wire wherein an end of the receptacle is attached to a "fish wire" which is drawn through the conduit as the receptacle is fed into the conduit. In a preferred embodiment, the receptacle is placed within a flexible material housing.

In a first embodiment, the receptacle is placed into the conduit so that a first end of the receptacle is adjacent or extends out of the first end of the conduit, and a second end of the receptacle is adjacent or extends of the second end of the conduit. Once the receptacle is inserted, and after the electrical lines are installed, a fire suppressant or compositions thereof are placed into the receptacle which can expand to the predetermined size of the receptacle, such as a polypropylene member. The material selected is for its ability to be drawn through the conduit without tearing, and for its ability to hold the hydrated material over a long period of time. In an alternative embodiment, the receptacle is placed within a housing that provides protection to the receptacle while the receptacle is being drawn through the conduit. In this embodiment, the receptacle may be made of a material having a thinner wall that may not otherwise be strong enough to be pulled through 300 plus feet of conduit.

Once the receptacle is placed within the conduit, a fire suppressor or compositions thereof are placed within the receptacle, and the receptacle is then sealed on both ends. Unique to this invention is the ability to retrofit existing conduits as the receptacle can be pulled through the conduit when the wiring has been previously installed.

Should an arcing occur, the receptacle bursts at the arcing location and the fire suppression and extinguishing properties of the fire suppressant or compositions thereof, would immediately extinguish any associated fire. The fire suppressant or compositions thereof provide an insulating ability to inhibit arcing, suppressing of the fires, until a lineman can turn off the power and repair the problem. In some embodiments, use of a flexible receptacle having elastic properties, such as that provided by rubber wherein the receptacle would expel the fire suppressant or compositions thereof similarly to a balloon to saturate the area with the fire suppressant or compositions thereof.

Accordingly, it is an objective of the present invention to provide a receptacle for placement of fire suppressant or compositions thereof within a conduit line for instant extinguishment of fires.

It is a further objective of the present invention to provide a method of installing that allows a receptacle to be inserted into a conduit, with or without electrical wires, and filled with a predetermined amount of fire suppressant or compositions thereof providing a non conductive material for use in fire suppression and extinguishment.

It is a further objective of the present invention to provide a receptacle that can be placed within a flexible material housing for ease of positioning within aging conduit or conduit containing obstacles such as existing wires.

Still another objective of the present invention is to provide an in-line pipe fire extinguisher that, if exhausted, leaves a residual that can be removed by vacuuming.

It is still yet another objective of the present invention to provide a device to work with any fire suppressant or fire suppressant compositions.

Still another objective of the present invention is to teach a process for extinguishing existing conduit fires by filling the conduit with a fire suppressant or compositions thereof, flushing the fire suppressant or compositions thereof from the conduit upon fire extinguishment, drawing the replacement electrical lines through the conduit, pulling a first end of an empty elongated receptacle through said conduit, filling said receptacle with a fire suppressant or compositions thereof, and sealing each end of said receptacle to maintain said fire suppressant or compositions thereof in a predetermined position. Wherein the receptacle will burst upon subjection to high heat/fire causing a release of the fire suppressant or compositions thereof for suppression of a hot spot before a fire starts, or extinguishment of a fire once started.

Still another objective of the invention is to teach a method of extinguishing fires in wood conduit including the use of a natural pepper or other rodent repellants to inhibit rodent infestation.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
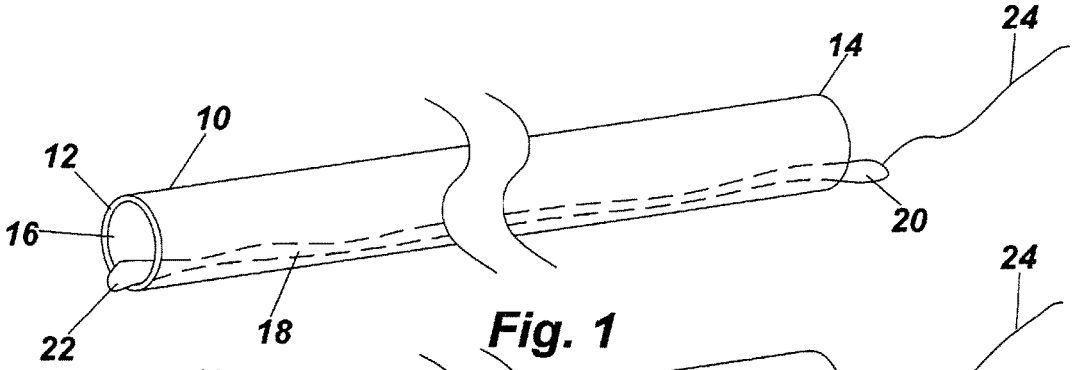
FIG. 1 is a pictorial view of a conduit with an unfilled receptacle.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

The present invention relates to a unique technique or method of extinguishing electrical fires and suppressing the spread of electrical fires. This unique technique utilizes a fire suppressant or compositions thereof in an amount sufficient to extinguish an electrical fire and suppress the spread of the electrical fire. The present invention utilizes fire suppressant or compositions thereof, such as, for example, biodegradable, super absorbent, aqueous based polymers. Examples of these polymers are: cross-linked modified polyacrylamides/potassium acrylate or polyacrylamides/sodium acrylate. Other suitable polymers include, albeit not limited to, carboxy-methylcellulose, alginic acid, cross-linked starches, and cross-linked polyamino acids. In some preferred embodiments, the fire suppressant is a dry powder or dry granules.

The present invention relates to a device that is positioned within an electrical conduit for immediate fire suppression. Electrical fires present different and unique problems pertaining to how these fires should be extinguished and suppressed. Water is normally used to fight fires because it can quickly cool down the burning material, there is usually a large supply of it ready for use, and it is relatively inexpensive. However, water and electricity are harmful, if not deadly to individuals, when brought into contact with each other. Normally, when water hits an active electrical circuit or electrical component, it shorts out the circuit or component, which usually results in destruction of the circuit or component. Further, when individuals are in close proximity to the water contacting the electricity, there is a strong likelihood that the water will act as a conductor and conduct the electricity to the individuals, resulting in serious injury or death of the individuals. Since water spreads rapidly in all directions on surfaces, electricity which comes in contact with the water will be conducted to wherever the water flows. Because it is difficult to prevent water from flowing to certain areas, there is a strong likelihood that individuals will be injured or killed when they come in contact with this water.

In some embodiments of the present invention, a fire suppressant or compositions thereof is placed with a receptacle that lines an electrical conduit. The fire suppressant or compositions thereof can be any known or conventional fire suppressants, including biodegradable, super absorbent, aqueous based polymers. Examples of these polymers are cross-linked modified polyacrylamides/potassium acrylate or polyacrylamides/sodium acrylate. Other suitable polymers include, albeit not limited to, carboxy-methylcellulose, alginic acid, cross-linked starches, and cross-linked polyaminoacids. Examples of known fire suppressants include without limitation, those marketed under the brand name of FIREICE, CEMDAL AQUA SHIELD, BARRICADE, THERMO-GEL, WILDFIRE AFG FIREWALL, BIOCENTRAL BLAZETAMMER, PHOS-CHEK INSUUL, and THERMO GEL. As used herein, a "fire suppressant" composition is meant to be inclusive of all components of the composition. In some embodiments, the fire suppressant composition comprises one or more fire suppressant compounds. In other embodiments, the fire suppressant composition comprises one or more common components of fire suppressant formulations, such as: fire suppressant salts, known or conventional fire suppressants, corrosion inhibitors, spoilage inhibitors, foaming agents, non foaming agents, flow conditioners, stability additives, thickening agents, pigments, or the like.

In some embodiments, a conventional fire suppressant comprises penta-bromodiphenyl ether, octa-bromodiphenyl ether, deca-bromodiphenyl ether, short-chain chlorinated paraffins (SCCPs), medium-chain chlorinated paraffins (MCCPs), hexabromocyclododecane (HBCD), tetrabromobisphenol A (TBBPA), tetrabromobisphenol A ether, pentabromotoluene, 2,3-dibromopropyl-2,4,6-tribromophenyl ether, tetrabromobisphenol A, bis(2,3-dibromopropyl ether), tris(tribromophenoxy)triazine, tris(2-chloroethyl)phosphate (TCEP), tris(2-chloro-1-methylethyl)phosphate (TCPP or TMCP), tris(1,2-dichloropropyl)phosphate (TDCP), 2,2-bis(chloromethyl)-trimethylene bis(bis(2-chloroethyl)phosphate), melamine cyanurate, antimony trioxide $Sb_2O_3$ (ATO), boric acid, ammonium polyphosphate (APP), aluminum ammonium polyphosphate, aluminum hydroxide, magnesium hydroxide red phosphorous, 1,2-bis(tribromophenoxy)ethane, 2,4,6-tribromophenyl glycidyl ether, tetrabromo phthalic anhydride, 1,2-bis(tetrabromo phthalimide) ethane, tetrabromo dimethyl phthalate, tetrabromo disodium phthalate, decabromodiphenyl ether, tetradecabromodi(phenoxyl)benzene, 1,2-bis(pentabromophenyl)ethane, bromo-trimethyl-phenyl-hydroindene, pentabromobenzyl acrylate, pentabromobenzyl bromide, hexabromobenzene, pentabromotoluene, 2,4,6-tribromophenyl maleimide, hexabromo cyclododecane, N,N'-1,2-bis(dibromonorbornyl dicarbimide) ethane, pentabromochloro-cyclohexane, tri(2,3-dibromopropyl)isocyanurate, bromo-styrene copolymer, tetrabromobisphenol A-carbonate oligomer, polypentabromobenzyl acrylate, polydibromophenylene ether; chlorinated flame retardants such as dechlorane plus, HET anhydride (chlorendic anhydride), perchloro pentacyclodecane, tetrachloro bisphenol A, tetrachlorophthalic anhydride, hexachlorobenzene, chlorinated polypropylene, chlorinated polyvinyl chloride, vinyl chloride-vinylidene chloride copolymer, chlorinated polyether, hexachloroethane; organic phosphorus flame retardants such as 1-oxo-4-hydroxymethyl-2,6,7-trioxa-1-phosphabicyclo[2,2,2]octane, 2,2-dimethyl-1,3-propanediol-di(neopentyl glycol)diphosphate, 9,10-dihydro-9-oxa-10-phosphaphenanthrene-10 oxide, bis(4-carboxyphenyl)-phenyl phosphine oxide, bis(4-hydroxyphenyl)-phenyl phosphine oxide, phenyl(diphenyl sulfone) phosphate oligomer; phosphorus-halogenated flame retardants such as tris(2,2-di(bromomethyl)-3-bromopropyl) phosphate, tris(dibromophenyl)phosphate, 3,9-bis(tribromophenoxy)-2,4,8,10-tetraoxa-3,9-diphosphaspiro[5,5]-3,9-di-oxo-undecane, 3,9-bis(pentabromophenoxy)-2,4,8,10-tetraoxa-3,9-diphosphaspiro[5,5]-3,9-dioxo-undecane, 1-oxo-4-tribromophenoxycarbonyl-2,6,7-trioxa-1-phosphabicyclo[2,2,2]octane, p-phenylene-tetrakis(2,4,6-tribromophenyl)-diphosphate, 2,2-di(chloromethyl)-1,3-propanediol-di(neopentyl glycol)diphosphate, 2,9-di(tribromoneopentyloxy)-2,4,8,10-tetraoxa-3,9-diphosphaspiro[5,5]-3-,9-dioxo-undecane; nitrogen-based flame retardants or phosphorus-nitrogen-based flame retardants such as melamine, melamine cyanurate, melamine orthophosphate, dimelamine orthophosphate, melamine polyphosphate, melamine borate, melamine octamolybdate, cyanuric acid, tris(hydroxyethyl)isocyanurate, 2,4-diamino-6-(3,3,3-trichloro-propyl)-1,3,5-triazine, 2,4-di(N-hydroxymethylamino)-6-(3,3,3-trichloro-propyl-1,3,5-triazine), diguanidine hydrophosphate, guanidine dihydrogen phosphate, guanidine carbonate, guanidine sulfamate, urea, urea dihydrogen phosphate, dicyandiamide, melamine bis(2,6,7-trioxa-phospha-bicyclo[2.2.2]octane-1-oxo-4-methyl)-hydroxy-phosphate, 3,9-dihydroxy-3,9-dioxo-2,4,8,10-tetraoxa-3,9-diphosphaspiro[5.5]undecane-3,9-dimelamine, 1,2-di(2-oxo-5,5-dimethyl-1,3-dioxa-2-phosphacyclohexyl-2-amino) ethane, N,N'-bis(2-oxo-5,5-dimethyl-1,3-dioxa-2-phosphacyclohexyl)-2,2'-m-phenylenediamine, tri(2-oxo-5,5-dimethyl-1,3-dioxa-2-phosphacyclohexyl-2-methyl) amine, hexachlorocyclotriphosphazene; and inorganic flame retardants such as red phosphorus, ammonium polyphosphate, diammonium hydrophosphate, ammonium dihydrogen phosphate, zinc phosphate, aluminum phosphate, boron phosphate, antimony trioxide, aluminum hydroxide, magnesium hydroxide, hydromagnesite, alkaline aluminum oxalate, zinc borate, barium metaborate, zinc oxide, zinc sulfide, zinc sulfate heptahydrate, aluminum borate whisker, ammonium octamolybdate, ammonium heptamolybdate, zinc stannate, stannous oxide, stannic oxide, ferrocenc, ferric acetone, ferric oxide, ferro-ferric oxide, ammonium bromide, sodium tungstate, potassium hexafluorotitanate, potassium hexafluorozirconate, titanium dioxide, calcium carbonate, barium sulfate, sodium bicarbonate, potassium bicarbonate, cobalt carbonate, zinc carbonate, basic zinc carbonate, heavy magnesium carbonate, basic magnesium carbonate, manganese carbonate, ferrous carbonate, strontium carbonate, sodium potassium carbonate hexahydrate, magnesium carbonate, calcium carbonate, dolomite, basic copper carbonate, zirconium carbonate, beryllium carbonate, sodium sesquicarbonate, cerium carbonate, lanthanum carbonate, guanidine carbonate, lithium carbonate, scandium carbonate, vanadium carbonate, chromium carbonate, nickel carbonate, yttrium carbonate, silver carbonate, praseodymium carbonate, neodymium carbonate, samarium carbonate, europium carbonate, gadolinium carbonate, terbium carbonate, dysprosium carbonate, holmium carbonate, erbium carbonate, thulium carbonate, ytterbium carbonate, lutetium carbonate, aluminium diacetate, calcium acetate, sodium bitartrate, sodium acetate, potassium acetate, zinc acetate, strontium acetate, nickel acetate, copper acetate, sodium oxalate, potassium oxalate, ammonium oxalate, nickel oxalate, manganese oxalate dihydrate, iron nitride, sodium nitrate, magnesium nitrate, potassium nitrate, zirconium nitrate, calcium dihydrogen phosphate, sodium dihydrogen phosphate, sodium dihydrogen phosphate dihydrate, potassium dihydrogen phosphate, aluminum dihydrogen phosphate, ammonium dihydrogen phosphate, zinc dihydrogen phosphate, manganese dihydrogen phosphate, magnesium dihydrogen phosphate, disodium hydrogen phosphate, diammonium hydrogen phosphate, calcium hydrogen phosphate, magnesium hydrogen phosphate, ammonium phosphate, magnesium ammonium phosphate, ammonium polyphosphate, potassium metaphosphate, potassium tripolyphosphate, sodium trimetaphosphate, ammonium hypophosphite, ammonium dihydrogen phosphite, manganese phosphate, dizinc hydrogen phosphate, dimanganese hydrogen phosphate, guanidine phosphate, melamine phosphate, urea phosphate, strontium dimetaborate hydrogen phosphate, boric acid, ammonium pentaborate, potassium tetraborate octahydrate, magnesium metaborate octahydrate, ammonium tetraborate tetrahydrate, strontium metaborate, strontium tetraborate, strontium tetraborate tetrahydrate, sodium tetraborate decahydrate, manganese borate, zinc borate, ammonium fluoroborate, ammonium ferrous sulfate, aluminum sulfate, potassium aluminum sulfate, ammonium aluminum sulfate, ammonium sulfate, magnesium hydrogen sulfate, aluminum hydroxide, magnesium hydroxide, iron hydroxide, cobalt hydroxide, bismuth hydroxide, strontium hydroxide, cerium hydroxide, lanthanum hydroxide, molybdenum hydroxide, ammonium molybdate, zinc stannate, magnesium trisilicate, telluric acid, manganese tungstate, manganite, cobaltocene, 5-aminotetrazole, guanidine nitrate, azobisformamide, nylon powder, oxamide, biuret, pentaerythritol, decabromodiphenyl ether, tetrabromophthalic anhydride, dibromoneopentyl glycol, potassium citrate, sodium citrate, manganese citrate, magnesium citrate, copper citrate, ammonium citrate, nitroguanidine.

In some embodiments, the fire suppressant or compositions thereof is in dry form. In other embodiments, the fire suppressant or compositions thereof are hydrated. The fire suppressant or compositions thereof can be a liquid, foam, or semi-liquid form, such as, for example, a gel having varying viscosities.

In some embodiments, a fire suppressant or compositions thereof comprises an aqueous admixture of super absorbent polymer and water having properties which enable the super absorbent polymer and water admixture to be confined to a particular area because of its relatively high viscosity. The properties of the admixture, in particular its viscosity, enable the admixture to remain on vertical, horizontal and curved surfaces formed by the conduit and wires placed therein. Unlike pure water, the admixture does not provide an electrically conductive path. In some embodiments, the present invention adds a predetermined amount of the super absorbent polymer to a predetermined amount of water to obtain an admixture which has properties that enable the admixture to suppress the spread of an electrical fire and extinguish any fire that has attached itself to the individual. In some embodiments, the amounts are from about 1 to 5 pounds of dry super absorbent polymer to about 20 to 40 gallons of water, the amount placed within the receptacles is dependent upon the volume of the receptacles.

Currently, firefighters apply water to the electrical conduits which are on fire and which are typically adjacent to other conduits and components making it difficult to control where the water goes. This contact of water on electrical conduits/components that are not on fire results in substantial unnecessary damage to these conduits/components. In embodiments, the present invention enables a controlled dispersion of fire suppressant or compositions thereof, for example, a super absorbent polymer water mixture, to a specific area for the primary purpose of protecting suppressing the electrical fire at the immediate point of origin. The admixture adheres to the interior of the particular conduit, without affecting adjacent conduits/components. Thus, a substantial safety factor is gained because electrical conduits/components are not sprayed and the admixture is not conductive like water.

Besides the risk of electrocution from using water to douse an electrical fire, water will not suppress the noxious and/or toxic gases produced by burning electrical wires, insulation and other components. In some embodiments, an admixture of potassium based super absorbent polymer, marketed under the trademark FIREICE®, and water has physical and chemical properties which enable the admixture to entrap and retain the noxious and/or toxic gasses and prevent the release of these gases into the atmosphere. This is an important advantage that the present invention has over the prior art because it prevents the noxious and/or toxic gases from reaching and affecting the lineman and/or firefighters.

When there are electrical fires in conduits, the firefighters contact the electrical utility to have the electrical power turned off so they can fight the fire. In rare instances, the electrical power is not turned off which may result in serious injury and/or death of the firefighters when they apply water to the electrical fire. In some embodiments, a fire suppressant or compositions thereof comprises properties such that the fire suppressant or compositions thereof will not readily flow or run from the area into which the fire suppressant or compositions thereof has been applied. Therefore, even in embodiments wherein the fire suppressant or compositions thereof contains water, when the fire suppressant or compositions thereof are applied to a live electrical wire or component, the electricity will not travel back to the firefighter because the fire suppressant or compositions thereof will remain in the immediate area where the fire suppressant or compositions thereof has been applied due to its physical properties and not travel down the conduit. In some embodiments, the fire suppressant or compositions thereof comprise a super absorbent polymer.

Referring to FIG. 1, illustrated is a conduit 10 is depicted having a first end 12, a second end 14 and an interior cavity 16. An empty receptacle 18 having a first end 20 and a second 22 is illustrated having been drawn through the conduit by fish line 24. In operation, the first end 20 is drawn attached to a fish line which is pulled through the conduit. The fish line 24 is then pulled drawing the first end 20 through the conduit until it near the second end 14 of the conduit, preferable the first end 20 extends slightly beyond the second end 14. The second end 22 of the receptacle 18 is also placed adjacent to the first end 12, preferable the second end 22 extends slightly beyond the first end 12. The second end 22 is cut to size and tied off or otherwise sealed.

The receptacle 18 is constructed from any natural or synthetic materials, including flexible, semi-flexible or combinations thereof. Flexible material such as latex, natural latex rubber, low density polypropylene, polyurethane, polyisoprene or other synthetic materials which have elastic properties can be used. The material selected is for its ability to be drawn through the conduit without tearing, and for its ability to hold the hydrated material over a long period of time without evaporation. In some embodiments, the flexible material comprises rubber, plastic, neoprene, poly tubing PVC, elastomers or combinations thereof. Useful elastomers include diene-rubbers, such as styrene-butadiene rubber (SBR), cis-butadiene rubber (BR), natural rubber (NR); polyolefin plastomers, such as ethylene-butene, ethylene-hexene, and ethylene-octene plastomers; polyolefin elastomers, such as propylene-ethylene, propylene-hexene, ethylene-octene elastomers; and thermoplastic elastomers (TPE), such as hydrogenated styrene-butadiene (or isoprene) block copolymers, polyester, and polyamide TPE; and combinations of two or more of the foregoing. In some embodiments, the flexible material can include fibers which may further impart strength or flexibility. Micro- and nano-fibers useful in the materials of the present disclosure are of a flexible solid material and can be any known in the art. Examples include, but are not limited to, glass, magnesium oxysulfate whiskers, wollastonite calcium metasilicate fibers, halloysite aluminosilicate nanotubes, carbon nanofibers (CNF), multi-walled carbon nanotubes (MWNT), single-wall carbon nanotubes (SWNT), exfoliated graphites, graphenes, and combinations of two or more of the foregoing.

The amount of fibers used in will vary depending on desired physical properties and performance characteristics. Typically, fibers are present in the composite at 10 wt % to 80 wt % based on the total weight of the composite. More typically, the fibers are present in the composite at from 15 wt % to 60 wt %. Yet more typically, the fibers are present in the composite at from 20 wt % to 50 wt %. Useful fibers have a diameter of about 1 nanometer (nm) to about 5 microns.

In some embodiments, the receptacle comprises areas having a thinner wall or material having a lower melting temperature as to compared to the rest of the receptacle such that it melts or perforates when subjected to heat, e.g. an electrical fire, allowing for the fire suppressant or compositions thereof to extrude into the conduit and extinguishing the fire. In other embodiments, the receptacle comprises rigid ends. In other embodiments, the receptacle is constructed from one or more materials.

In some embodiments, the receptacle can comprise any dimension and shape as long as the receptacle can fit into the conduits and extend throughout the length of the conduit in which the receptacle is being inserted. In some embodiments, the receptacle is collapsible and inflates when the fire suppressant or compositions thereof, are injected into the receptacle.

Figure 2:
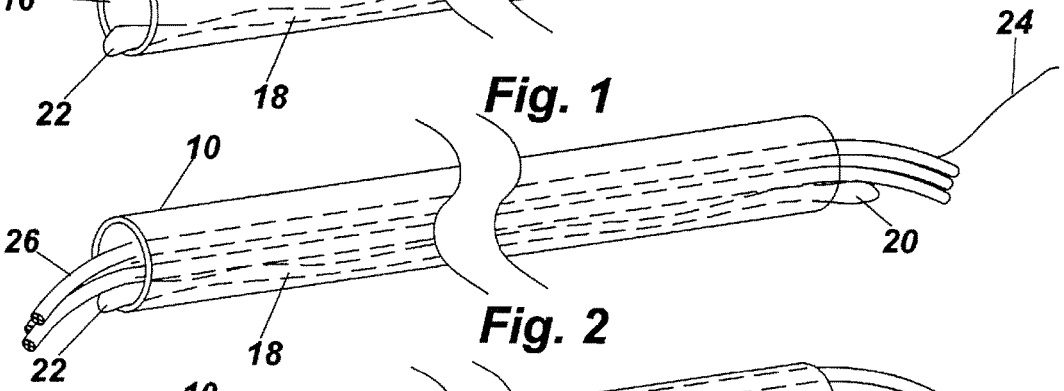
FIG. 2 is FIG. 1 with electrical wires installed.
Figure 3:
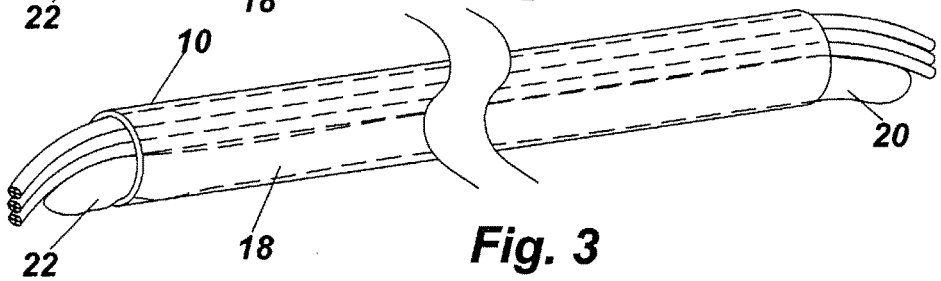
FIG. 3 is FIG. 2 with a filled receptacle.

Now referring to FIGS. 2 and 3, electrical lines 26 are drawn through the conduit in the conventional manner. Once the receptacle 18 is inserted, and after the electrical lines 26 are installed, a fire suppressant or compositions thereof, are placed into the receptacle 18. In one preferred embodiment the receptacle 18 is formed of plastic, preferably polypropylene. In an alternative embodiment the receptacle can be made of an elastic material, or have elastic provisions such as latex rubber wherein the receptacle 18 is pressurized. The amount of pressure can be less than 10 psi, the pressurization is to provide a flow of fluid toward the area that has burst due to a rupture caused by heat or fire. Once the fire suppressant or compositions thereof is inserted the receptacle is sealed on both ends. In some embodiments, the fire suppressant comprises a biodegradable, super absorbent, aqueous based cross linked modified polyacrylamides/potassium acrylate polymers. Other polymers may be used but not with the same quality level, examples of these polymers are cross-linked modified polyacrylamides/sodium acrylate, carboxymethylcellulose, alginic acid, cross-linked starches, and cross-linked polyaminoacids. The fire suppressant or compositions thereof, is injected into the first end 20.

Figure 4:
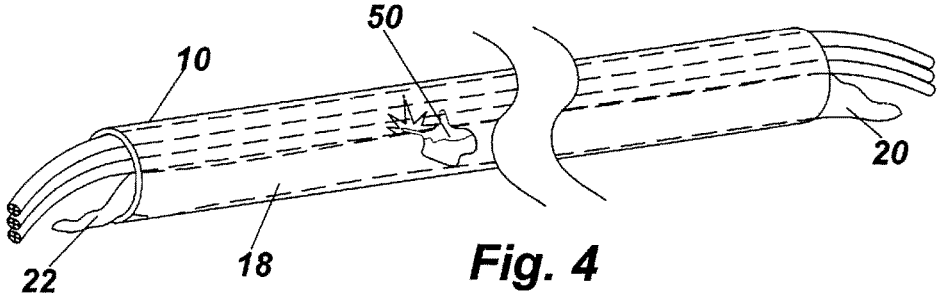
FIG. 4 is a pictorial view of a conduit wherein an electrical arc causes a rupture of the filled receptacle.
Figure 5:
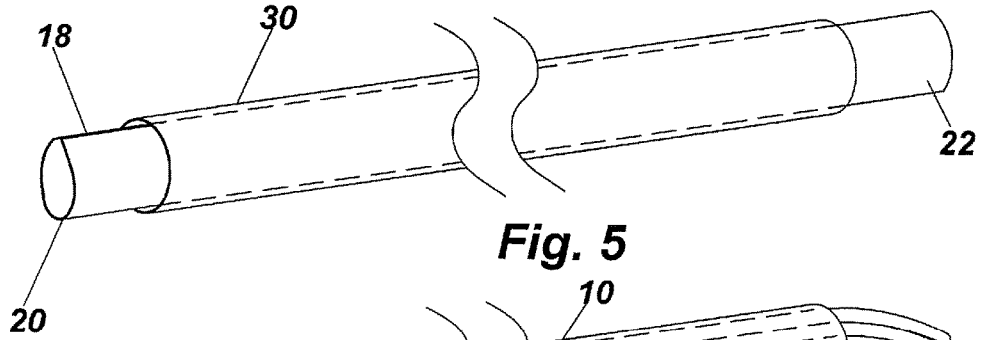
FIG. 5 is a perspective view of a sleeve with a receptacle installed.

The receptacle 18 is filled as shown in FIG. 3, expanding to fill the remaining space with the interior cavity 16. By allowing the first end 20 and the second end 22 to extend beyond the first and second conduit ends 12 & 14, the condition of the receptacle can be immediately determined. As illustrated in FIG. 4, a wire malfunction within the conduit creates either heat or an arc resulting in a burst 50 of the receptacle 18. Should the receptacle 18 have any elastic properties, the receptacle 18 would forcibly expel the admixture similarly to a popped balloon to saturate the area with the admixture. In some embodiments, the fire suppressant or compositions thereof, has a viscosity and is distributed in a manner to be contained within a specific area without spreading to adjacent areas. These properties enable electrical fires to be extinguished more rapidly and not flare back up.

The fire suppressant volume can be monitored by simply looking at the first and second receptacle ends 20 & 22 to determine if the receptacle 18 has ruptured or otherwise lost the charge of material. Should the receptacle burst, the evaporation of any water would leave only the receptacle and fire suppressant within the conduit, neither of which is flammable or would otherwise affect the conduit.

For example a 100 foot long conduit may hold about 5 gallons of a fire suppressant. The viscosity of the fire suppressant or compositions thereof can be such that the fire suppressant or compositions thereof will not move or migrate past the area into which it was introduced. Therefore, the fire suppressant or compositions thereof can be delivered to a specific area within the conduit and it will remain in that area and will not flow into other areas. Should the material be discharged, clean-up can be performed by vacuuming the material once dried.

When the conduit may include items capable of causing a breach of the receptacle, such as when existing wires remain in the conduit, or the conduit may include burrs, a sleeve 30 is employed. The sleeve 30 is constructed from a fabric material such as nylon or polyester constructed to shield the receptacle 18 from damage but retain similar bursting reactions to heat and fire. In other embodiments, the sleeve is constructed from nylon, polyester, elastomers, polymers, microfibers, nanofibers or combinations thereof. The sleeve can be any shape or thickness, for example, a thin solid sheet so that the receptacle is completely shielded. In other embodiments, the sleeve, is perforated, webbed, shaped like a net, comprises bubbles, patterned surfaces, e.g. grooves and the like.

Figure 6:
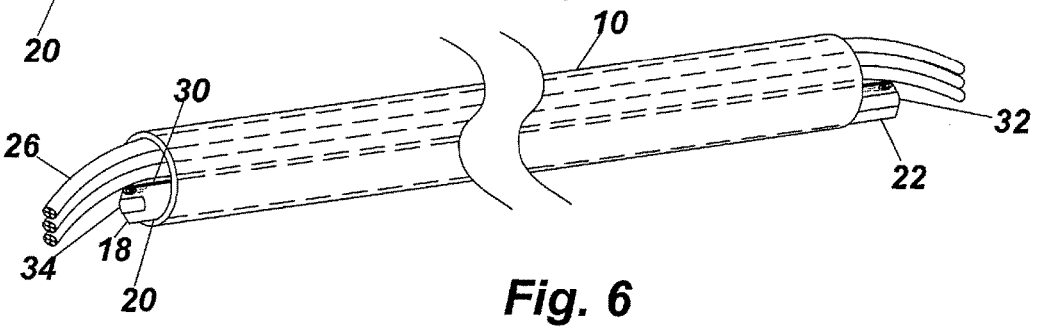
FIG. 6 is a pictorial view with the sleeve and receptacle placed within a conduit.
Figure 7:
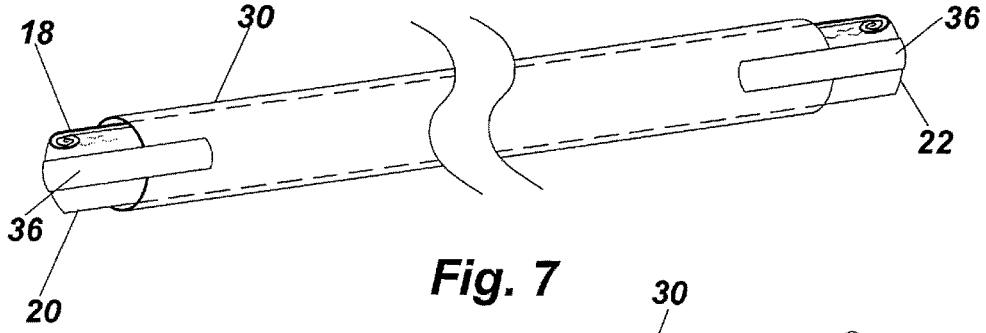
FIG. 7 is a view depicting a filled receptacle with clamps.

As with the previous embodiment, the receptacle 18 is pulled through the conduit by use of a snake puller wherein the sleeve 30 simply adds a layer of protection. In this regard the receptacle 18 can remain a thin wall plastic material. Once the sleeve 30 and receptacle 18 has been positioned within the conduit 10 a first end 20 of the receptacle receives the fire suppressant or compositions thereof. The receptacle 18 is filled, expanding to fill the remaining space with the interior of the sleeve 30. By allowing the first end 20 and the second end 22 to extend beyond the first and second conduit ends 12 & 14, the condition of the receptacle 18 can be immediately determined, see FIG. 6. Once the receptacle 18 is filled the second end 22 is sealed closed by a clamp 32. The receptacle 18 is under little or no pressure so the material can be folded over and a clamp 32 used to releasably secure the hydrated polymer within the receptacle 18. Similarly, clamp 34 is used to seals the first end 20. In an alternative embodiment, the clamps 36 can be made of a biasing material to maintain pressure within the receptacle, see FIG. 7. The clamps 36 are of a length to capture a portion of the receptacle 18 and sleeve 30. When placed under a slight pressure, the receptacle 18 will expel the admixture at the point of breach. Placing slight pressure on the receptacle 18 further allows an instant inspection of the condition of the device. If the receptacle 18 has not been breached, the receptacle 18 will have a bloated type appearance. Should the system be discharged, the pressure would be lost and it will be recognized that a lines require immediate service. The biasing material can be plastic, steel or any type of device that operates like a clothes pin for clamping items together.

By use of a flexible receptacle 18 having elastic properties, such as that provided by natural latex rubber, the receptacle 18 may be designed to expel the fire suppressant or compositions thereof similar to a popped balloon to saturate the area around the burst with the fire suppressant or compositions thereof. The fire suppressant or compositions thereof can be premixed or mixed on location without special tools or even the use of an electrical mixer.

Figure 8:
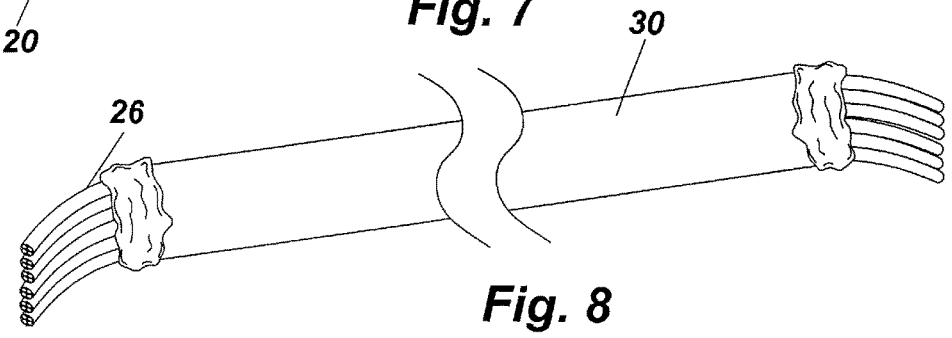
FIG. 8 is a pictorial view of a conduit having end plugs.

FIG. 8 depicts a conduit 30 having wires 26 drawn therethrough. In this embodiment the conduit is undersized, bent, or otherwise limited in passing through the fire suppressant filled receptacles. In this embodiment the conduit becomes the receptacle and each end is packed with a polyurethane expanding foam thereby sealing the fire suppressant within the conduit. Filling of the conduit can be performed by use of a conventional expandable fill port which is a flexible device that expands in width before releasing of the pressurize material, the expandable fill port sealing the conduit so that the fire suppressant or compositions thereof is forced into the conduit. Once filled, the polyurethane expanding foam is added to the ends of the conduit for sealing the material therein.

In older cities, such as New York, many of the conduits are formed from wood and prohibitively expensive to replace. To suppress an electrical fire within a conduit the conduit is filled with a fire suppressant or compositions thereof and maintained within the conduit for at least one hour to assure the fire is removed. When the fire suppressant is used to suppress a fire in conduits made from wood, the use of a rodent repellant such as cayenne pepper can be included. Rodents remain adverse to peppers and the saturating of the conduit with pepper leaves a natural rodent repellant that will last for years. However, any commercially available rodent repellant may be used.

The conduit 10 is then flushed with water and the damaged electrical wires repaired. The Applicant's flexible receptacle 18 is inserted into the conduit 10, the receptacle 18 having a length approximately equal to the length of the conduit 10. For conduits 10 of any length, a sleeve 30 having protective qualities is placed around the receptacle 18 to provide ease of drawing the receptacle 18 into the conduit 10. For instance, a sleeve 30 made from nylon provides a slippery surface that allows for ease of snaking through the length of the conduit 10 as well as protecting the receptacle 18 from tears or the like breaches.

The receptacle 18 is then filled with a second fire suppressant or compositions thereof and each end of the receptacle 18 is sealed. When the receptacle 18 is breached due to heat indicative of a fire, the second fire suppressant is released at the point of breach. If the receptacle 18 includes an elastic material, the fire suppressant can be pressurized against the breach.

Tests were carried out with a super absorbent polymer marketed under the trade name as FIREICE™. The admixture is non-conductive and capable of suppressing harmful air emission released from electrical files.

1. Test Description

A total of five field test air sampling collections were undertaken on Jan. 18, 2011, at the High Current Laboratory (HCL) to evaluate the air emissions released from the application of Applicant super absorbent polymer marked under the trademark FIREICE® to artificially faults generated using copper and aluminum cables. The five test scenarios were air sampled for airborne metals and organics. The description of the tests is given in Table 1.

TABLE 1

Test description

| Test # | Shot # | Test description | Cable description |
|---|---|---|---|
| 1 | 119 | New cables with copper conductor artificially faulted to create arc with no FIREICE ® added. Target fault current: 2 kA. Fault duration: until fault self-extinguished. | coned 500 kcmil Cu 600 V EAM/LSNH installed in coned precast concrete distribution box type B-3.6 |
| 2 | 120 | New cables with copper conductor artificially faulted to create arc with FIREICE ® added at the on-set of arc. Target fault current: 2 kA. Fault duration: until fault self-extinguished. | coned 500 kcmil Cu 600 V EAM/LSNH installed in coned precast concrete distribution box type B-3.6 |
| 3 | 121 | New cables with copper conductor artificially faulted to create arc with FIREICE ® added at the on-set of arc—this was a repeat of test #2 due to poor arc generation and non-propagation of arc. Target fault current: 2 kA. Fault duration: until fault self-extinguished. | coned 500 kcmil Cu 600 V EAM/LSNH installed in coned precast concrete distribution box type B-3.6 |
| 4 | 122 | New cables with aluminum conductor artificially faulted to create arc with FIREICE ® added at the on-set of arc. | coned 350 MCM Al 600 V EPR installed in coned precast concrete distribution box type B-3.6 |
| 5 | 123 | New cables with aluminum conductor artificially faulted to create arc with "FIREICE ®" added to concrete box to cover faulted cables prior to high current being applied to create arc. Target fault current: 2 kA. Fault duration: until fault self-extinguished. | coned 350 MCM Al 600 V EPR installed in coned precast concrete distribution box type B-3.6 |

In all the tests the cables were installed at the bottom of the concrete box, and the fault between the cables was created using a fuse wire. The approximate dimensions of the interior volume of the concrete box are: 33"×33"×24". One calorimeter was installed above the concrete box to measure the incident energy generated by the fault.

The sampling equipment consisted of five separate sampling trains, each with a sampling pump drawing air through various air sampling components using a calibrated mass flow controller to maintain constant flow. The sampling time for each train was two minutes during each of the 5 arc test scenarios. For each sampling train a flow rate was selected based on the type of air sample being collected. The five sampling trains consisted of the following components and the air flow rate utilized:

1. A sampling train consisting of a MCE (mixed cellulose ester) filter in a cartridge filter holder for aerosol collection generated during the arc. The air flow rate through the filter was set to 1 L/min.

2. A sampling train for organic compounds using two CARBOTRAP™ 300 sampling tubes in series (front-back arrangement) was placed with the front sampling tube inlet at the edge of the concrete bunker. The air flow rate for the organics sampling tube train was 0.050 L/min.

3. A sampling train consisting of three impingers in series with 1M nitric acid in the first two impingers and an empty third impinger was used to trap airborne metals. The metals train air flow rate was set to 0.50 L/min.

4. A sampling train identical to the one described in 3 but with 0.5M KOH added to the first two impingers and an empty third impinger was setup plus an additional CARBOTRAP™ 300 organic compound sampling train as described in 2 was added in series to the outlet of the last impinger. The air sampling flow rate was set to 0.251/min for this train.

5. A final sampling train consisting of 3 impingers in series as described in 3 but with KOH added to the first two impingers and an empty third impinger to capture acidic species possibly generated during the FIREICE® tests. The air sampling flow rate was set to 0.25 L/min for this train.

2. Organic Compound Sampling Results—Carbotrap™ 300 Tube Analyses

The organic compounds released to air were captured using CARBOTRAP™ 300 tubes after the air sample passed through a KOH impinger train. The sampling flow rate was 0.25 L/min. The total mass of organic compounds collected during each of the five arc fault tests are given in Table 2. The organic compounds identified in the air samples are summarized in Table 3.

TABLE 2

Total Mass of Organic Compounds Collected on CARBOTRAP ™ 300 Sample Tubes and Estimated FIREICE ® Inhibition Ratio for Organic Compound Release

| | Test Number & Description | Total Mass of Organics Collected on CARBOTRAP ™ 300 Tubes | Minimum Removal Efficiency Compared to Test 1 |
|---|---|---|---|
| 1 | Pair of New Neoprene Copper Cables—No FIREICE ® Applied | 615 | — |
| 2 | Pair of New Neoprene Jacketed Copper Cables—FIREICE ® Added at On-Set of Arc | 189 | 3.2 |
| 3 | Pair of New Neoprene Jacketed Copper Cables—FIREICE ® Added at On-Set of Arc (Repeat) | 138 | 4.5 |
| 4 | Pair of New Neoprene Jacketed Aluminum Cables—FIREICE ® Added at On-Set of Arc | No Organic Compounds Detected | >61.5* |
| 5 | Pair of New Neoprene Jacketed Aluminum Cables—FIREICE ® Added Prior to Arc Generation | No Organic Compounds Detected | >61.5* |

Note:
Assumed minimum removal efficiency is assumed to be >61.5 as detection limit for any single organic compound is 10 ng.

TABLE 3

Organic Compounds Identified in High Flow Samples

| | Test Number & Description | Organic Compounds Collected on CARBOTRAP ™ 300 Tubes Passage Through KOH Impingers | Total Organic Compound Mass (Front + Back) (ng) |
|---|---|---|---|
| 1 | Pair of New Neoprene Copper Cables—No FIREICE ® Added | ethane-l-chloro-1,1 difluoro* | 48000* |
| | | 2-butene, 2-methyl | 18 |
| | | 1,3-butadiene, 2-methyl | 40 |
| | | 1,3 pentadiene | 35 |
| | | 1,4 pentadiene | 14 |
| | | cyclopentane | 23 |
| | | 1-pentene, 2-methyl | 36 |
| | | benzene | 62 |
| | | 1,4-cyclohexadiene | 25 |
| | | 3-hexen-l-ol | 28 |
| | | toluene | 237 |
| | | ethylbenzene | 48 |
| | | styrene** | 2740** |
| | | a-methyl styrene** | 53** |
| 2 | Pair of New Neoprene Jacketed Copper Cables—FIREICE ®-Added at On-Set of Arc | ethane-l-chloro-1,1-difluoro | 68* |
| | | 1,3-butadiene | 14 |
| | | 1-pentene, 2-methyl | 21 |
| | | propane, 2-methyl-1-nitro | 31 |
| | | 3-heptene | 8 |
| | | benzene | 62 |
| | | butane, I-chloro-2-methyl | 25 |
| | | styrene** | 99** |
| | | unknown | 28 |
| 3 | Pair of New Neoprene Jacketed Copper Cables—FIREICE ®-Added at On-Set of Arc (Repeat) | ethane-l-chloro-1,1-difluoro | 264* |
| | | 1-propene, 2-methyl | 16 |
| | | 1,3-butadiene | 40 |
| | | 2-butene, 2-methyl | 12 |
| | | 1-pentene, 2-methyl | 25 |
| | | benzene | 34 |
| | | unknown | 11 |
| 4 | Pair of New Neoprene Jacketed Aluminum Cables—FIREICE ® Added at On-Set of Arc | No organic compounds detected on both front and back CARBOTRAP ™ 300 tubes | 0 |

TABLE 3-continued

| Organic Compounds Identified in High Flow Samples | | | |
|---|---|---|---|
| | Test Number & Description | Organic Compounds Collected on CARBOTRAP ™ 300 Tubes Passage Through KOH Impingers | Total Organic Compound Mass (Front + Back) (ng) |
| 5 | Pair of New Neoprene Jacketed Aluminum Cables—FIREICE ® Added Prior to Arc Generation | No organic compounds identified on both front and back CARBOTRAP ™ 300 | 0 |

Notes:

*The ethane-1-chloro-1,1-difluoro is suspected to be contamination resulting from the partial decomposition of impinger train holder used during testing. The Freon HCFC 142b released during tests 1 to 3 is the trapped blowing agent used to make the closed cell foam. The foam was used to support and secure the impinger trains. Not included in organic compound mass reported.

**The styrene and α-methyl styrene are unintentional contaminants generated from the destruction of the aerosol filter holder used during the first arc fault Test-1. The filter- holder was too close to the arc-fault zone and did not survive Test-1. The styrene values are not included in organic compound mass reported.

Direct Air Sampling

The total mass of organic compounds in the air samples collected directly on to CARBOTRAP™ 300 tubes during each of the five arc fault tests are given in Table 4. The organic compounds captured with the CARBOTRAP™ 300, tubes and subsequently detected during analysis are listed in Table 5. The sampling flow rate was 0.05 L/min.

TABLE 4

| Total Mass of Organic Compounds on Direct Air Sample onto CARBOTRAP ™ 300 Tubes and FIREICE ® Inhibition Ratio | | | |
|---|---|---|---|
| | Test Number & Description | Total Mass of Organics Collected on. CARBOTRAP ™ 300 Tubes (Front + Back) (ng) | Minimum Removal Efficiency Compared to Test 1 |
| 1 | Pair of New Neoprene Jacketed Copper Cables—No FIREICE ® | 158 | |
| 2 | Pair of New Neoprene Jacketed Copper Cables—FIREICE ®-Added at On-Set of Arc | 65 | 2.4 |
| 3 | Pair of New Neoprene Jacketed Copper Cables—FIREICE ®-Added at On-Set of Arc (Repeat) | 15 | >10 |
| 4 | Pair of New Neoprene Jacketed Aluminum Cables—FireIce ® Added at On-Set of Arc | None Detected | >15.8 |
| 5 | Pair of New Neoprene Jacketed Aluminum Cables—FIREICE ® Added Prior to Arc Generation | 10 | 15.8 |

The total organic compound concentration measured directly with the CARBOTRAP™ 300 tubes associated with the copper cable arc fault in Test-1 is estimated to be 1.6 mg/m3 without the application of FIREICE®. For Test-2 through Test-5 the organic compound concentrations are estimated to be 0.6 mg/m3, 0.15 mg/m3, 0.0 mg/m3 and 0.1 mg/m3, respectively.

The FIREICE® application is effective in reducing organic emissions for both the copper cables and the aluminum cables. The removal efficiencies estimated in Table 2 and Table 4 compare well. The application of FIREICE® reduces organic emissions when applied with the arc fault is active. The presence of external contamination confirms the effective organic sampling in the vicinity of the arc fault during the five tests.

TABLE 5

| Organic Compounds Identified in Direct Air Samples Collected on CARBOTRAP ™ 300 Tubes | | | |
|---|---|---|---|
| | Test Number &Description | Organic Compounds Collected on CARBOTRAP ™ 300 | Organic Compound Mass (ng/tube) |
| 1 | Pair of New Neoprene Copper Cables—No FIREICE ® Added | Ethane-l-chloro-1,1 difluoro* | 53* |
| | | 1-pentene, 2-methyl | 15 |
| | | Benzene | 64 |
| | | toluene** | 41 |
| | | Styrene | 70 |
| | | methyl styrene** | 217* |
| | | isobutyl nitrile | 11 |

TABLE 5-continued

Organic Compounds Identified in Direct Air Samples Collected on CARBOTRAP ™ 300 Tubes

| | Test Number &Description | Organic Compounds Collected on CARBOTRAP ™ 300 | Organic Compound Mass (ng/tube) |
|---|---|---|---|
| | | propane, 2-methyl-1-nitro | 14 |
| | | unknown | 13 |
| 2 | Pair of New Neoprene Jacketed Copper Cables—FIREICE ®-Added at On-Set of Arc | 1-propene, 2-methyl | 8 |
| | | 1,3 butadiene | 16 |
| | | 2-butene, 2-methyl | 8 |
| | | 1-pentene, 2-methyl | 23 |
| | | unknown | 10 |
| 3 | Pair of New Neoprene Jacketed Copper Cables—FIREICE ®-Added at On-Set of Arc (Repeat) | 1-pentene, 2-methyl | 15 |
| 4 | Pair of New Neoprene Jacketed Aluminum Cables—FIREICE ® Added at On-Set of Arc | No organic compounds detected on both front and back CARBOTRAP ™ 300 tubes | 0 |
| 5 | Pair of New Neoprene Jacketed Aluminum Cables—FIREICE ® Added Prior to Arc Generation | No organic compounds identified on both front and back CARBOTRAP ™ 300 tubes | 0 |
| | | Unknown peak (Front tube only) | 10 |

Notes:

*The ethane-l-chloro-1,1-difluoro is suspected to be contamination resulting from the partial decomposition of impinger train holder used during testing. The Freon HCFC 142b released during testing is the trapped blowing agent used to make the closed cell foam. The foam was used to support and secure the impinger trains. The Freon was not included in organic compound mass reported.

**The styrene and α-methyl styrene are unintentional contaminants generated from the destruction of the aerosol filter holder used during the first arc fault Test-1. The filter- holder was too close to the arc-fault zone and did not survive Test-1. The styrene values are not included in organic compound mass reported.

TABLE 6

Metals Analysis Results (PPM) Filter Pack Sampling~2m Above Arc Fault

| Met-al | Blank (Avg) | Test 2 (Cu) | Test 3 (Cu) | Test 4 (Al) | Test 5 (Al) |
|---|---|---|---|---|---|
| Al | <0.5 | 3.15 | 6.81 | 1.48 | <0.5 |
| Ca | 2.15 | 1.80 | 4.96 | 2.52 | 1.93 |
| Cu | <1.5 | 94.8 | 312 | 1.98 | <1.5 |
| Fe | <0.25 | <0.25 | 2.85 | <0.25 | <0.25 |
| K | 67 | 68 | 39 | 28 | 23 |
| Mg | 0.19 | 8.4 | 18.9 | 0.25 | <0.1 |
| Na | <2.5 | <2.5 | 5.8 | <2.5 | <2.5 |
| P | <1 | <1 | 1.2 | <1 | <1 |
| S | <1 | <1 | 3.7 | <1 | <1 |
| Si | <1 | 4.3 | 20.5 | <1 | <1 |
| Ag | <0.005 | <0.005 | 0.007 | <0.005 | <0.005 |
| As | <0.05 | <0.05 | <0.05 | <0.05 | <0.05 |
| B | <0.05 | <0.05 | <0.05 | <0.05 | <0.05 |
| Ba | 0.007 | 0.012 | 0.022 | 0.008 | 0.006 |
| Bi | <0.005 | <0.005 | <0.005 | <0.005 | <0.005 |
| Be | <0.005 | <0.005 | <0.005 | <0.005 | <0.005 |
| Cd | <0.005 | <0.005 | <0.005 | <0.005 | <0.005 |
| Co | <0.005 | <0.005 | <0.005 | <0.005 | <0.005 |
| Cr | <0.005 | <0.005 | <0.005 | <0.005 | <0.005 |
| Cs | <0.005 | <0.005 | <0.005 | <0.005 | <0.005 |
| Li | <0.005 | <0.005 | 0.013 | <0.005 | <0.005 |
| Mn | 0.005 | 0.006 | 0.053 | 0.007 | 0.006 |
| Mo | <0.005 | <0.005 | <0.005 | <0.005 | <0.005 |
| Ni | 0.010 | 0.013 | 0.024 | 0.016 | 0.011 |
| Pb | <0.005 | 1.93 | 4.79 | 0.063 | 0.015 |
| Sb | 0.003 | 2.17 | 5.19 | 0.072 | 0.017 |
| Se | <0.05 | <0.05 | <0.05 | <0.05 | <0.05 |
| Sn | 0.029 | 0.036 | 0.028 | 0.006 | 0.005 |
| Sr | 0.007 | 0.006 | 0.028 | 0.009 | 0.006 |
| Th | <0.005 | <0.005 | <0.005 | <0.005 | <0.005 |
| Ti | 0.151 | 0.122 | 0.309 | 0.007 | 0.007 |
| Th | <0.005 | <0.005 | <0.005 | <0.005 | <0.005 |
| W | <0.005 | <0.005 | <0:005 | <0.005 | <0.005 |
| Zr | <0.005 | <0.005 | <0.005 | <0.005 | <0.005 |
| V | <0.05 | <0.05 | <0.05 | <0.05 | <0.05 |
| Zn | 0.037 | 1.22 | 3.02 | 0.054 | 0.042 |
| Hg | <0.005 | <0.005 | <0.005 | <0.005 | <0.005 |
| U | <0.005 | <0.005 | <0.005 | <0.005 | <0.005 |

TABLE 7

Metals Analysis Results (PPM) from Acid Impinger Sampler Train

| Metal | MDL | Test 1 (Cu) | Test 2 (Cu) | Test 3 (Cu) | Test 4 (Al) | Test 5 (Al) |
|---|---|---|---|---|---|---|
| Al | <0.01 | 0.145 | 0.272 | 0.330 | 0.328 | 0.640 |
| Ca | <0.01 | 0.485 | 1.30 | 0.388 | 0.523 | 0.094 |
| Cu | <0.01 | 0.22 | 0.918 | 0.816 | 0.66 | 0.062 |
| Fe | <0.005 | 0.02 | 0.056 | 0.023 | 0.028 | 0.025 |
| K | <0.01 | 1.24 | 0.896 | 0.644 | 77.8 | 13000 |
| Mg | <0.002 | 0.042 | 0.134 | 0.056 | 0.318 | 0.012 |
| Na | <0.05 | 0.951 | 0.727 | 1.78 | 0.905 | 10.5 |
| P | <0.02 | <0.02 | 0.049 | <0.02 | <0.02 | <0.02 |
| S | <0.05 | 0.043 | 0.070 | 0.099 | 0.043 | 0.504 |
| Si | <0.1 | 0.303 | 0.48 | 1.10 | 0.49 | 21.4 |
| Ag | <0.0001 | 0.004 | 0.005 | 0.004 | 0.005 | 0.002 |
| As | <0.001 | <0.001 | <0.001 | 0.001 | <0.001 | <0.001 |
| B | <0.025 | 0.853 | 0.638 | 1.61 | 0.922 | 2.88 |
| Ba | <0.0001 | 0.006 | 0.008 | 0.007 | 0.006 | 0.002 |
| Bi | <0.001 | <0.001 | <0.001 | <0.001 | <0.001 | <0.001 |
| Be | <0.001 | <0.001 | <0.001 | <0.001 | <0.001 | <0.001 |
| Cd | <0.0001 | <0.0001 | <0.0001 | <0.0001 | 0.0002 | <0.0001 |
| Co | <0.0001 | 0.0001 | 0.0004 | <0.0001 | 0.0002 | 0.0001 |
| Cr | <0.0001 | 0.0007 | 0.0009 | 0.0006 | 0.0006 | 0.019 |
| Cs | <0.0001 | <0.0001 | <0.0001 | <0.0001 | 0.002 | 0.819 |
| Li | <0.001 | <0.001 | <0.001 | <0.001 | <0.001 | 0.004 |
| Mn | <0.0001 | 0.001 | 0.002 | 0.0006 | 0.0010 | 0.015 |
| Mo | <0.0001 | 0.0002 | 0.0002 | 0.0003 | 0.0002 | 0.0020 |
| Ni | <0.0001 | 0.002 | 0.001 | 0.002 | 0.002 | 0.001 |
| Pb | <0.0001 | 0.003 | 0.003 | 0.008 | 0.009 | 0.008 |
| Sb | <0.001 | 0.002 | 0.002 | 0.007 | 0.003 | <0.001 |
| Se | <0.001 | <0.001 | <0.001 | <0.001 | <0.001 | 0.004 |
| Sn | <0.0001 | 0.0004 | 0.0003 | 0.0002 | 0.0005 | 0.0020 |
| Sr | <0.0001 | 0.002 | 0.005 | 0.002 | 0.003 | 0.001 |
| Th | <0.0001 | <0.0001 | <0.0001 | <0.0001 | <0.0001 | <0.0001 |
| Ti | <0.0001 | 0.001 | 0.004 | 0.002 | 0.002 | 0.014 |
| Tl | <0.0001 | <0.0001 | <0.0001 | <0.0001 | <0.0001 | <0.0001 |
| W | <0.0001 | <0.0001 | <0.0001 | <0.0001 | 0.0001 | 0.037 |
| Zr | <0.0001 | 0.0002 | 0.0008 | 0.0007 | 0.0007 | 0.027 |
| V | <0.0001 | <0.0001 | <0.0001 | <0.0001 | <0.0001 | 0.0002 |
| Zn | <0.0001 | 0.01 | 0.009 | 0.01 | 0.021 | 0.003 |
| Hg | <0.0001 | <0.0001 | <0.0001 | <0.0001 | <0.0001 | <0.0001 |
| U | <0.0001 | <0.0001 | <0.0001 | <0.0001 | <0.0001 | <0.0001 |

A 2-liter air sample was taken through a filter pack at about 2 meters above each arc test. Each available exposed filter was analyzed for metals and other elements. The results for 38 element analyses are presented in Table 6.

Some key observations are noted from filter analysis for the Test-2 through Test-5 data available in Table 6: A key result noted is the below detection of aluminum for Test 5 compared to a measurable detection in Test 4. Both tests used new aluminum cables for the arc fault but in the Test 5 case the fault zone was encapsulated in FIREICE® prior to arc fault generation whereas for Test 4 the arc fault was initiated into air and then FIREICE® was added to quench the arc fault. The lead (Pb), antimony (Sb), magnesium (Mg), copper (Cu), and calcium (Ca) results add confirmation to the reduction of released metals with the arc fault encapsulated.

The counter ion for FIREICE® is potassium (K). For all four arc fault tests, the filter analysis did not detect potassium above the nominal background concentration of potassium present on the filter prior to exposure. This is evidence that FIREICE® did not undergo detectable degradation during the arc faults where FIREICE® was applied.

Test 2 and Test 3 were essentially duplicate tests using new neoprene jacketed copper cables for the arc fault with Test 3 having the more sustained arc fault. The procedure for applying FIREICE® was the same for both tests. At the on-set of the arc fault the addition of FIREICE® was begun and continued until the concrete cell was about ½ full. For the more sustained arc fault (Test 3) the key metals from the vaporized copper cable as measured with the filter pack were about 3 to 4 times higher than the metals released in the much shorter arc period of Test 2. Key metals released were aluminum (1.7%), copper (80%), magnesium (4.8%), zinc (0.8%), lead (1.2%), calcium (1.3%) and antimony (1.3%) with remaining components at <1% to only present at trace levels.

The estimated airborne total metals concentration for Test 3 is 0.17 $g/m^3$ and for Test 2 is 0.058 $g/m^3$. Similarly for the aluminum cables the estimated airborne total metals concentration for Test 4 is 0.003 $g/m^3$ and for Test 5 is 0.001 $g/m^3$.

For comparison the Ontario Ministry of Labor time-weighted average exposure concentration (TWAEC) for a variety of fumes and particulate, ranges from 0.003 to 0.01 $g/m^3$ for 40-hr work week and for short term exposures, the particulate concentrations range from 0.005 to 0.02 $g/m^3$ for a maximum 15 minute continuous exposure depending on the fume and particulate present.

Observations from the metals train analysis for Tests 1 through 5 are summarized below and are based on the metal/element analysis data present in Table 7.

The high level of potassium in the Test 5 results were from the entrainment of airborne FIREICE® into the first impinger as the arc generated gas that ejected some of the FIREICE® material into the air. This is confirmed by the increase in silica, sodium and sulfur.

For Test 4 a significant level of copper (0.66 ppm) is measured as copper residue from Tests 1 to 3 is released during the aluminum cable arc fault. However in Test 5 very little copper is detected (>10× less detected 0.062 ppm) with the FIREICE® encapsulating the arc fault zone. This also confirmed by the similar reduction in magnesium detected.

The impinger samples collected similar amounts of metals for the copper cable arc fault tests. The metal concentration levels were and are given in Table 7.

The application of FIREICE® to neoprene jacketed copper and aluminum cables is effective in reducing airborne organic compounds and also airborne metals. Removal efficiencies from 2 times to greater than 15 times can be expected when added to an active arc fault. For a FIREICE® encapsulated arc fault greater than 60 times removal of metals and arc generated arc products is possible based on the five tests performed. The optimum admixture is ratio of 100 grams of FIREICE to 2.5 gallons of clean clear water.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device for suppressing an electrical fire within an electrical conduit comprising:

a receptacle constructed from a flexible material having a tubular shape from a continuous sidewall with a first end constructed and arranged to be drawn through an entry end to a length of electrical conduit containing a plurality of electrical wires and a second end juxtapositioned to the entry end of said electrical conduit;

a hydrated super absorbent polymer fire suppressant which is electrically non-conductive positioned within said receptacle;

a first clamp for sealing said first end and a second clamp for sealing said second end of said receptacle;

wherein said receptacle is ruptured when an electrical wire is overheated indicative of a fire whereby said hydrated fire suppressant is released for suppression of the fire.

2. The device for suppressing an electrical fire according to claim 1, further comprising a sleeve positioned around said receptacle.

3. The device for suppressing an electrical fire according to claim 1, wherein said receptacle is formed of a material having elastic properties.

4. The device for suppressing an electrical fire according to claim 1, wherein the flexible material is selected from the group consisting of: rubber, polypropylene, polyurethane, polyisoprene, elastomers, polymers, microfibers or nanofibers.

5. The device for suppressing an electrical fire according to claim 1, wherein said receptacle is pressurized.

6. The device for suppressing an electrical fire within an electrical conduit according to claim 1, wherein said hydrated super absorbent polymer fire suppressant is mixed in a ratio of 1 to 5 pounds of dry super absorbent polymer with 20 to 40 gallons of water.

7. A device for suppressing an electrical fire within an electrical conduit comprising:

a receptacle constructed from a flexible material having a tubular shape from a continuous sidewall with a first end constructed and arranged to be drawn through an entry end to a length of electrical conduit containing a plurality of electrical wires and a second end juxtapositioned to an entry end of said electrical conduit;

a hydrated super absorbent polymer fire suppressant or compositions thereof which are electrically non-conductive, positioned within said receptacle;

a first clamp for sealing said first end and a second clamp for sealing said second end of said receptacle with said hydrated fire suppressant in said receptacle;

a sleeve positioned around said receptacle, wherein said sleeve and said receptacle is ruptured when an electrical wire is overheated indicative of a fire whereby said hydrated fire suppressant is released for suppression of the fire.

8. The device for suppressing an electrical fire according to claim 7, wherein the receptacle is constructed from a flexible material, the flexible material is selected from the group consisting of: rubber, polypropylene, polyurethane, polyisoprene, elastomers, polymers, microfibers or nanofibers.

9. The device for suppressing an electrical fire according to claim 7, wherein said sleeve is selected from the group consisting of: nylon, polyester, elastomers, polymers, microfibers or nanofibers.

10. The device for suppressing an electrical fire according to claim 7, wherein said receptacle is constructed from a material having elastic properties.

11. The device for suppressing an electrical fire within an electrical conduit according to claim 7, wherein said hydrated super absorbent polymer fire suppressant is mixed in a ratio of 1 to 5 pounds of dry super absorbent polymer with 20 to 40 gallons of water.

* * * * *